US010565928B2

(12) United States Patent
Li et al.

(10) Patent No.: US 10,565,928 B2
(45) Date of Patent: Feb. 18, 2020

(54) METHOD AND APPARATUS FOR COMPENSATING IMAGE DATA FOR LED DISPLAY

(71) Applicant: SCT TECHNOLOGY, LTD., Grand Cayman (KY)

(72) Inventors: Eric Li, Milpitas, CA (US); Yi Zhang, Milpitas, CA (US); Shuang-Kuan Tang, Milpitas, CA (US)

(73) Assignee: SCT LTD., Grand Cayman (KY)

( * ) Notice: Subject to any disclaimer, the term of this patent is extended or adjusted under 35 U.S.C. 154(b) by 0 days.

(21) Appl. No.: 15/945,497

(22) Filed: Apr. 4, 2018

(65) Prior Publication Data

US 2019/0311673 A1 Oct. 10, 2019

(51) Int. Cl.
*G09G 3/3233* (2016.01)
*G09G 3/3208* (2016.01)

(52) U.S. Cl.
CPC ..... *G09G 3/3233* (2013.01); *G09G 3/3208* (2013.01); *G09G 2320/0626* (2013.01)

(58) Field of Classification Search
CPC ..... G09G 3/3233
See application file for complete search history.

(56) References Cited

U.S. PATENT DOCUMENTS 8,963,811 B2 2/2015 Li et al.
2011/0074799 A1* 3/2011 Wu ..... G09G 3/2018 345/532
2016/0019829 A1* 1/2016 Li ..... G09G 3/32 345/690
2016/0027385 A1* 1/2016 Li ..... G09G 3/32 345/82

OTHER PUBLICATIONS

Eric Li et al., Pending U.S. Appl. No. 15/901,712, filed Feb. 21, 2018.

* cited by examiner

*Primary Examiner* — William Boddie
*Assistant Examiner* — Andrew B Schnirel
(74) *Attorney, Agent, or Firm* — Novick, Kim & Lee, PLLC; Allen Xue

(57) ABSTRACT

An LED display system has an LED display panel coupled to a driver circuitry. The driver circuitry includes a scrambled PWM generator, a register, and a memory. The driver circuit receives an image data from an external source and, after certain compensations, the compensated data is sent to the scrambled PWM generator to be distributed according to a new set of rules. Compared with existing technologies, this LED display has a host of benefits, including having a uniform optical energy output at low brightness.

14 Claims, 5 Drawing Sheets

METHOD AND APPARATUS FOR COMPENSATING IMAGE DATA FOR LED DISPLAY

THE TECHNICAL FIELD

The present disclosure relates generally to methods and devices for driving a display. More particularly, this disclosure relates to methods and devices that compensate image data to improve the refresh rate and the uniformity in brightness for an LED display.

BACKGROUND

Modern LED (light emitting diode) display panels require higher grayscale to accomplish higher color depth and higher visual refresh rate to reduce flickering. For example, a 16-bit grayscale for a RGB LED pixel allows 16-bit levels ($2^{16}$=65536) for red, green, and blue LEDs, respectively. Such a RGB LED pixel is capable of displaying a total of $65536^3$ colors. One of the methods commonly employed to adjust LED grayscale is Pulse Width Modulation ("PWM"). Simply put, PWM generates a series of voltage pulses to drive an LED. When the voltage of the pulse is higher than the forward voltage of the LED, the LED is turned on. Otherwise, the LED remains off. Accordingly, when the pulse amplitude exceeds a threshold, the pulse duration (i.e., pulse width) of the PWM signal decides the on-time and off-time of the LED. The percentage of on-time over the sum of on-time and off-time (i.e., a PWM cycle) is the duty cycle, which determines the brightness of the LED. Configurations and operations of an exemplary LED display system, which includes LED topology, circuitry, PWM engines, etc., are explained in detail in U.S. Pat. No. 8,963,811, issued Feb. 24, 2015, as well as in the co-pending U.S. patent application Ser. No. 15/901,712, filed Feb. 21, 2018.

Another parameter for an LED display is the grayscale value, which is the level of brightness of the LED display. In a 16-bit resolution LED display, the grayscale value ranges from 0 (complete darkness) to 65535 (maximum brightness), corresponding to duty cycles from 0% to 100%. When the grayscale value is low, the brightness level of an LED is low. Conversely, when the grayscale is high, the brightness level is also high. LED displays often experience performance issues at low grayscale values.

A further parameter for the LED display is its Grayscale Clock ("GCLK") frequency, which is related to the maximum number of GCLK cycles ("GCLKs") in a data frame and the refresh rate of the display. In addition, a frame rate is the number of times a video source feeds an entire frame of new data to a display in one second. The refresh rate of an LED display is the number of times per second the LED display draws the data. The refresh rate equals the frame rate multiplied by the number of segments.

One of the advantages of PWM is that power loss in the switching devices is low. When a switch is turned off, there is practically no current. When the switch is turned on, there is almost no voltage drop across the switch. As a result, power losses in both scenarios are close to zero. On the other hand, PWM is defined by the duty cycle, switching frequency, and properties of the load. When the switching frequency is sufficiently high, the pulse train can be smoothed and the average analog waveform can be recovered. However, when the switching frequency is low, the off-time of LED will be noticeable and appears as flickers to a viewer.

Scrambled PWM ("S-PWM") modifies a conventional PWM and enables a higher visual refresh rate. To accomplish that, S-PWM scrambles the on-time in a PWM cycle into a number of shorter PWM pulses that sequentially drive each scan line. In other words, a total grayscale value is scrambled into a number of PWM pulses across a PWM cycle. In a conventional PWM scheme, there may be only one PWM pulse so that the LED is lit continuously for a period of time, leaving the LED unlit for the remainder of the time. In contrast, S-PWM allows the LED to emit light in consecutive short pulses in the PWM cycle so that the light pulses spread across the PWM cycle more evenly, avoiding or reducing flickers.

One PWM cycle has a number of GCLK cycles equaling 2 to the power of the number of control bits:

$$\text{Number_of_GCLKs}=2^{NUMBER_OF_CONTROL_BITS}.$$

For example, a 16-bit grayscale has 65536 GCLKs. Note that the number of GCLKs in one PWM cycle equals its grayscale value at the maximum brightness, i.e., the maximum pulse width. In some S-PWM, the total number of GCLKs can be divided into MSB (most significant bits) and LSB (least significant bits) of grayscale cycles. Each PWM cycle is divided into a number of segments (or sub-PWM cycles) according to the following equation:

$$\text{Number_of_Segments}=2^{NUMBER_OF_LSB}.$$

For a video source of a 60 Hz frame rate and a PWM cycle length of 8000 GCLKs, one may divide the PWM cycle into 32 segments (LSB=5) so that each segment has a pulse duration of 250 GCLKs. A total of grayscale value of 1600 GCLKs therefore can be distributed into 32 segments at 50 GCLKs in each segment, potentially increasing the refresh rate up to 32 times. However, when the PWM pulse duration (i.e., pulse width) in the segment is shorter than the time it takes to raise the LED voltage above its forward voltage, the LED remains unlit. U.S. Pat. No. 9,390,647 provides a solution that extends the pulse duration by adding a fixed number of GCLKs to the pulse. However, such an S-PWM scheme results in large increments in the optical energy output at the low brightness level, as explained elsewhere in this disclosure. Other technical schemes may require a second power source to provide additional driving current to extend the pulse duration, adding complexity and costs to the electrical system for the LED display.

Accordingly, there is a need for new systems and methods that improves image quality of the LED display without the shortcomings of the existing technologies.

SUMMARY OF INVENTION

An embodiment of the LED display system of this disclosure includes and LED display panel coupled to a driver circuitry. The driver circuitry includes a scrambled PWM generator, a register, and a memory. The scrambled PWM generator receives an image data of a grayscale value of (X+K). X is a grayscale value of a data from an external image source and K is a compensation value generated by the driver circuitry, According to one embodiment, the scrambled PWM generator distributes the grayscale value (X+K) into a plurality of segments according the following set of rules: when (X+K) equals or is smaller than $G_0*S_0$, $S=\text{ceil}((X+K)/G_0)$ and $R=\text{mod}(X+K, G_0)$; when (X+K) is larger than $G_0*S_0$, $M=\text{floor}((X+K)/S_0)$ and $L=\text{mod}(X+K, S_0)$.

In the equations above, $G_0$ is a grouping number and $S_0$ is a preset segment number stored in the driver circuitry. S is the number of output segments, among which S−1 segments has a pulse width of $G_0$ GCLKs and one segment has a pulse width of R.

Further, L is the number of segments that each receives a pulse width of M+1. Each of the remaining $S_0$−L segments receives a pulse width of M. Note that the unit of the pulse width or the grayscale value is GCLK. For example, a pulse width of M means a pulse width that has a time length of M GCLKs.

The group number $G_0$ can be pre-determined based on experience or obtained by calibrating the LED display for flickering. It can be stored in a memory in the driver circuitry. The compensation value K is related to a first set of calibration data obtained at high brightness and a second set of calibration data obtained at low brightness of the LED display. For example, K=(floor(p*X)+q)−X, wherein p is derived from the first set of calibration data and q is derived from the second set of calibration data.

In some embodiments, the LED display panel can be arranged in either the common cathode configuration or the common anode configuration. The LED display panel can be a large wall display for indoor or outdoor use. The LED display panel can also be a microdisplay for hand-held devices.

The current disclosure also provides a method for operating an LED display system. The LED display panel is coupled with a driver circuitry having a scrambled PWM generator. An image data of value X is to the driver circuitry. Data X is compensated by multiplying a calibration coefficient p in a multiplier. The data is further compensated by adding to it a grayscale value q in an adder. As such, a total compensation value K is added to X so that the compensated image data has a value of (X+K).

The compensated image data (X+K) is then sent to the scrambled PWM generator. The scrambled PWM generator scrambles the image data into a number of segments to generate short PWM pulses to be sent to the power or current sources.

The current disclosure further provides a method for compensating image data for an LED display system. The LED display panel is driven by a driver circuitry having a scrambled PWM generator. The driver circuitry is connected to a video source. The input image data from the video source is X. The compensated image data is floor(p*X)+q. The values of p, or q, or both are obtained by calibration. For example, the display panel is calibrated at a high brightness level for uniformity to determine the value of p and calibrated at a low brightness level for uniformity to determine a value of q. The values of p, or q, or both are pre-determined without calibration.

The values of p, or q, or both can be independently determined for each individual LED in the LED display. Alternatively, q is a constant for LEDs of a same color in the LED display, p is a constant for LEDs of a same color in the LED display, or both.

DESCRIPTIONS OF DRAWINGS

The teachings of the present disclosure can be readily understood by considering the following detailed description in conjunction with the accompanying drawings.

DETAILED DESCRIPTION OF THE EMBODIMENT

The Figures (FIG.) and the following description relate to the embodiments of the present disclosure by way of illustration only. It should be noted that from the following discussion, alternative embodiments of the structures and methods disclosed herein will be readily recognized as viable alternatives that may be employed without departing from the principles of the claimed inventions.

Reference will now be made in detail to several embodiments of the present disclosure(s), examples of which are illustrated in the accompanying figures. It is noted that wherever practicable similar or like reference numbers may be used in the figures and may indicate similar or like functionality. The figures depict embodiments of the present disclosure for purposes of illustration only. One skilled in the art will readily recognize from the following description that alternative embodiments of the structures and methods illustrated herein may be employed without departing from the principles of the disclosure described herein.

Used herein, the term "couple," "couples," "connect," or "connects" means either an indirect or direct electrical connection unless otherwise noted. Thus, if a first device couples or connects to a second device, that connection may be through a direct electrical connection, or through an indirect electrical connection via other devices or connections.

In this disclosure, the term "low brightness" (i.e., low grayscale) generally refers to situations when the input signal length is low, e.g., less than 4 times the rise time of the LED, or less than 3 times the rise time of the LED. Conversely, the term "high brightness" (i.e., high grayscale) refers to situations when the input signal length is high, e.g., more than 4 times the rise time, or more than 10 times the rise time of the LED.

Figure 1:
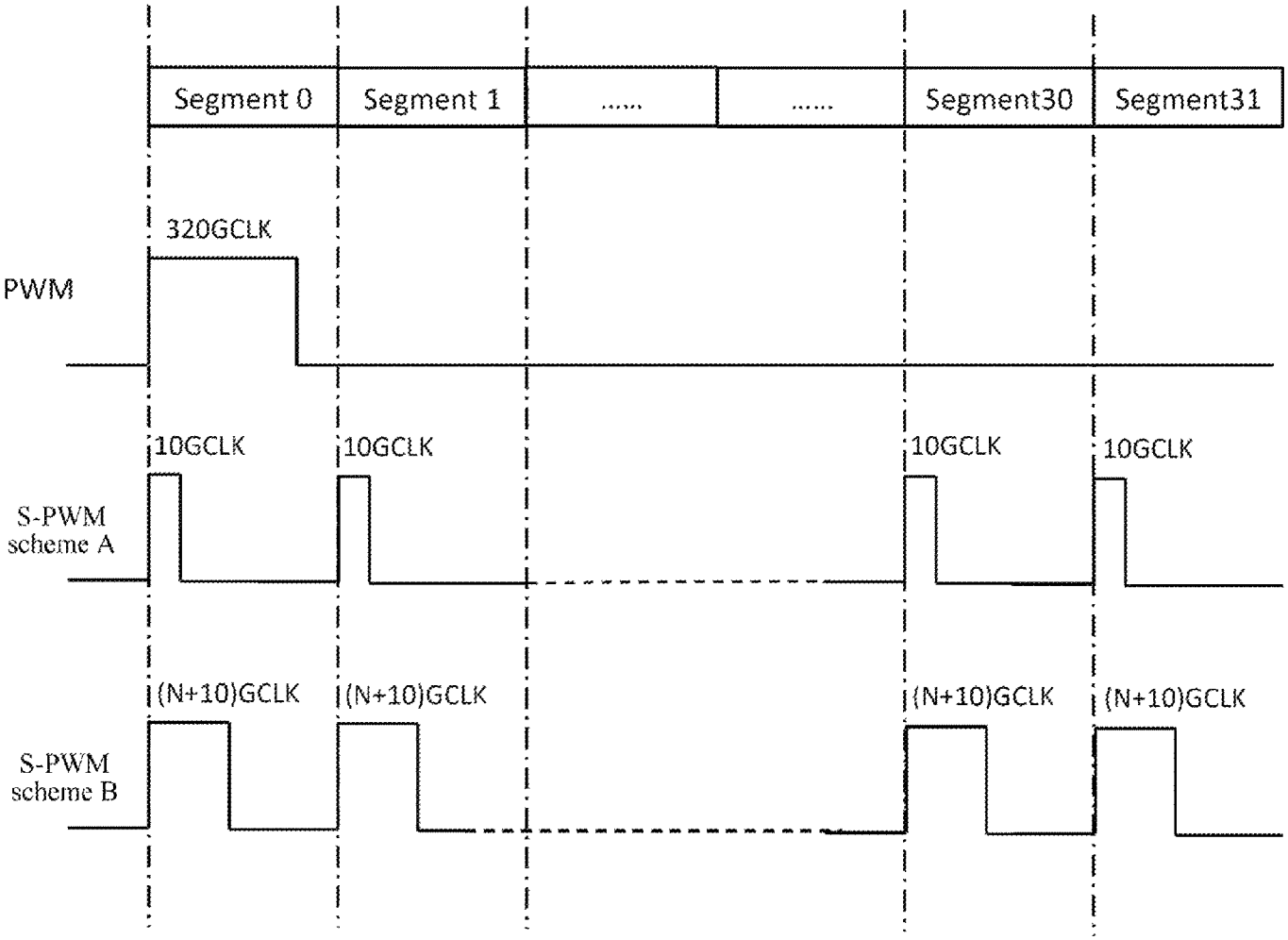
Prior Art FIG. 1
FIG. 1 is a diagram illustrating prior art S-PWM schemes A and B.

FIG. 1 illustrates two existing S-PWM schemes. The top panel shows that the grayscale value in one grayscale data input period is 320 GCLK cycles ("GCLKs"), i.e., the total width for the PWM pulse is 320 GCLKs in one grayscale data input period. In the S-PWM scheme A illustrated in middle panel in FIG. 1, the 320 GCLKs are distributed among 32 segments (Segment 0 to Segment 31) at a number of 10 GCLKs in each segment. In S-PWM scheme B shown in the bottom panel in FIG. 1, an offset value that equals N GCLKs is added to the PWM pulse in each segment so that the PWM pulse width is extended by N GCLKs, resulting in pulses having a width of (N+10) GCLKs. In S-PWM scheme B, the extended PWM pulse width extends beyond the rise time to the forward voltage of the LED ($V_f$) so that the LED would lit.

The current disclosure provides an inventive S-PWM scheme C. For illustrative purposes, X is the grayscale value of the input image data in one grayscale input period; K is the compensation value added to the input image data; $S_0$ is the segment number; and $G_0$ is the length of each segment.

In S-PWM scheme C, when (X+K) equals or is smaller than $G_0$*$S_0$, S=ceil((X+K)/$G_0$) and R=mod(X+K, $G_0$). S is the number of output segments, among which S−1 segments has a pulse width of G0 GCLKs and one segment has a pulse width of R. R is a positive integer less than $G_0$. Used herein, an output segment is a segment having at least 1 GCLK pulse width while a segment having no output pulse is hereby referred to as a "dark segment." Accordingly, $(S_0-S)$ segments are dark segments.

In contrast, when (X+K) equals or is larger than $G_0*S_0$, $M=\text{floor}((X+K)/S_0)$ and $L=\text{mod}(X+K, S_0)$. L is the number of segments that each has a pulse width of M+1, while the remaining $S_0-L$ segments each has a pulse width of M.

Applying this rule to the scenario of distributing 1 to 320 GCLKs into 32 segments ($S_0=32$), assuming the grouping number is 8 GCLKs ($G_0=8$), the distribution of the grayscale value can be illustrated in Tables 1 and 2 below. Table 1 shows the case for distributing grayscale values from 1 to 256 GCLKs (e.g., grayscale value$\leq S_0 \times G_0=256$), while Table 2 shows the result for distributing grayscale values from 257 to 320 GCLKs.

TABLE 1

| (X + K) GCLK Value | S # of output segments | $G_0$ GCLKs in each of the (S − 1) output segment | R GCLKs in one output segment | (32 − S) dark segment |
|---|---|---|---|---|
| 1 | 1 | 0 | 1 | 31 |
| 2 | 1 | 0 | 2 | 31 |
| 3 | 1 | 0 | 3 | 31 |
| 4 | 1 | 0 | 4 | 31 |
| 5 | 1 | 0 | 5 | 31 |
| 6 | 1 | 0 | 6 | 31 |
| 7 | 1 | 0 | 7 | 31 |
| 8 | 1 | 1 × 8 | 0 | 31 |
| 9 | 2 | 1 × 8 | 1 | 30 |
| 10 | 2 | 1 × 8 | 2 | 30 |
| . . . | . . . | . . . | . . . | . . . |
| 15 | 2 | 1 × 8 | 7 | 30 |
| 16 | 2 | 2 × 8 | 0 | 30 |
| 17 | 3 | 2 × 8 | 1 | 29 |
| . . . | . . . | . . . | . . . | . . . |
| 240 | 30 | 30 × 8 | 0 | 2 |
| 241 | 31 | 30 × 8 | 1 | 1 |
| . . . | . . . | . . . | . . . | . . . |
| 248 | 31 | 31 × 8 | 0 | 1 |
| . . . | . . . | . . . | . . . | . . . |
| 254 | 32 | 31 × 8 | 6 | 0 |
| 255 | 32 | 31 × 8 | 7 | 0 |
| 256 | 32 | 32 × 8 | 0 | 0 |

TABLE 2

| (X + K) GCLK Value | M GCLKs | M + 1 GCLKs | $S_0$ − L segments with M GCLKs | L segments with (M + 1) GCLKs |
|---|---|---|---|---|
| 257 | 8 | 9 | 31 | 1 |
| 258 | 8 | 9 | 30 | 2 |
| 259 | 8 | 9 | 29 | 3 |
| 260 | 8 | 9 | 28 | 4 |
| . . . | . . . | | . . . | . . . |
| 286 | 8 | 9 | 2 | 30 |
| 287 | 8 | 9 | 1 | 31 |
| 288 | 9 | 10 | 32 | 0 |
| 289 | 9 | 10 | 31 | 1 |
| 290 | 9 | 10 | 30 | 2 |
| . . . | . . . | | . . . | . . . |
| 318 | 9 | 10 | 2 | 30 |
| 319 | 9 | 10 | 1 | 31 |
| 320 | 10 | 11 | 32 | 0 |

Table 1 shows that when the grayscale value is smaller or equal to $S_0*G_0$, the available grayscale data are first put into one single segment until the PWM pulse width in that segment reaches $G_0$ before the remaining grayscale data is put into another segment that has less than $G_0$ PWM pulse width. Accordingly, the maximum PWM pulse width in each segment is $G_0$ (i.e., eight in this example). Consequently, at very low grayscale values, the priority is to fill individual segments until the segment has a pulse width $G_0$ while the remaining segments receive no signal and remain dark. Note that when the grayscale value equals $G_0*S_0$, every segment has a pulse width of $G_0$.

The rule of distribution changes when the grayscale value is larger than $G_0*S_0$. As shown in Table 2, the GCLK number in excess of $G_0*S_0$ is distributed 1 GCLK a time to a segment until all 32 segments have $(G_0+1)$ GCLKs. Then the excess GCLKs beyond $(G_0+1)*S_0$ is distributed one GCLK a time to each segment until all 32 segments have (G+2) GCLKs.

Accordingly, in this embodiment, the rule of distributing grayscale value into the segments when the grayscale value is larger than $S_0*G_0$ is the same as in the conventional S-PWM scheme. Nonetheless, when the grayscale value is low, i.e., less than $S_0*G_0$, this method maximizes the number of segments have at least a pulse width of $G_0$.

Figure 2:
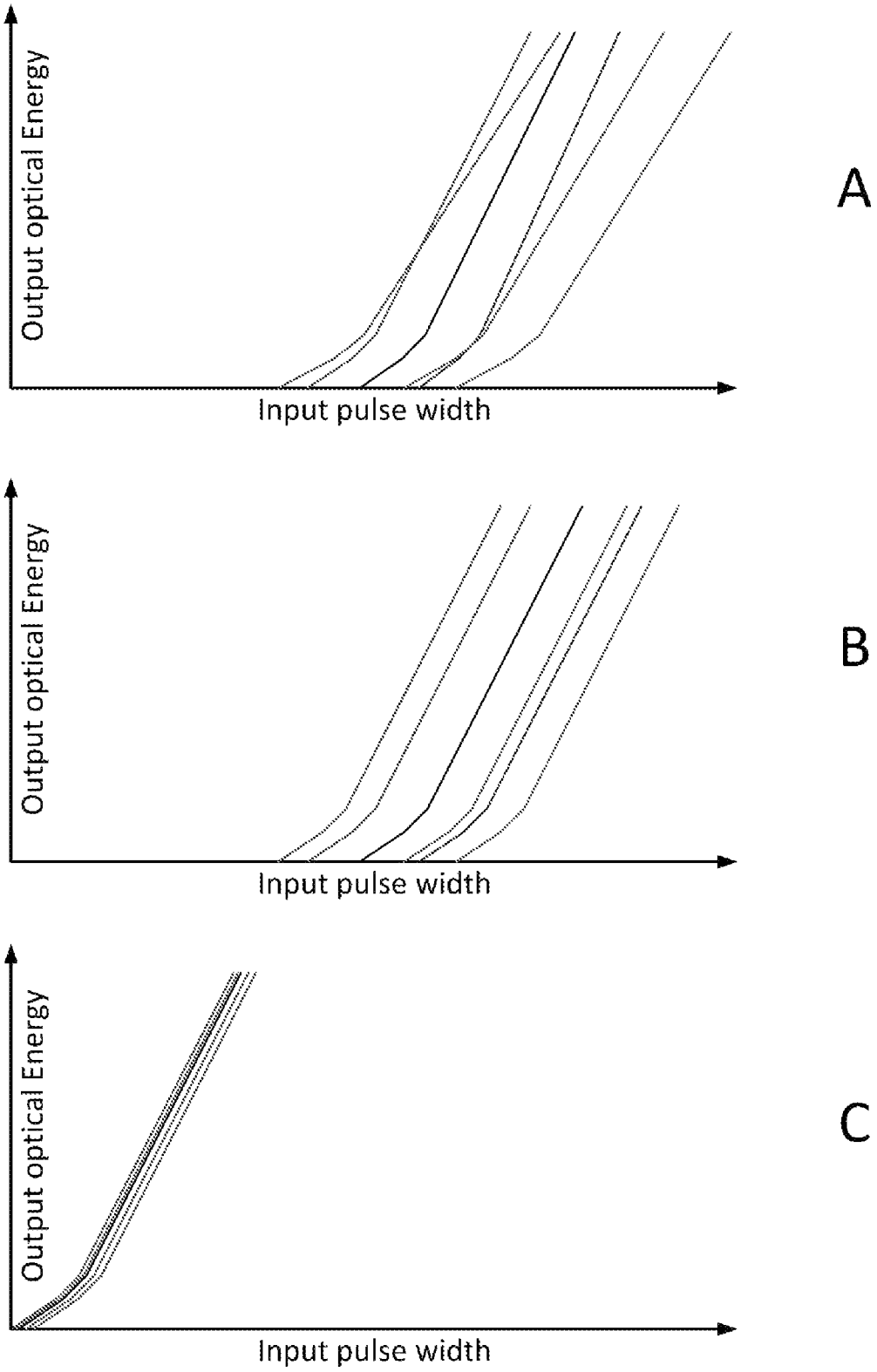
FIG. 2 shows the effect of the innovative S-PWM scheme C.

FIG. 2 demonstrates the effects of innovative S-PWM scheme C. Panel A, B, and C in FIG. 2 show the output optical energy (i.e., brightness) from a group of LEDs in response to input data length, i.e., input pulse width. Panel A shows the behavior of the LEDs without any compensation. The LEDs are not lit until the input pulse width exceeds a threshold level. Once the LEDs are lit, the energy output values of the LEDs increase linearly in general but at different rates. Panel B shows the result of a first compensation that improves the uniformity of the brightness of the LEDs at high brightness. Panel C shows the result of an embodiment of the current disclosure, which provides a second compensation in addition to the first compensation. After the second compensation, the LEDs emit light when the input pulse width is narrow.

Figure 3:
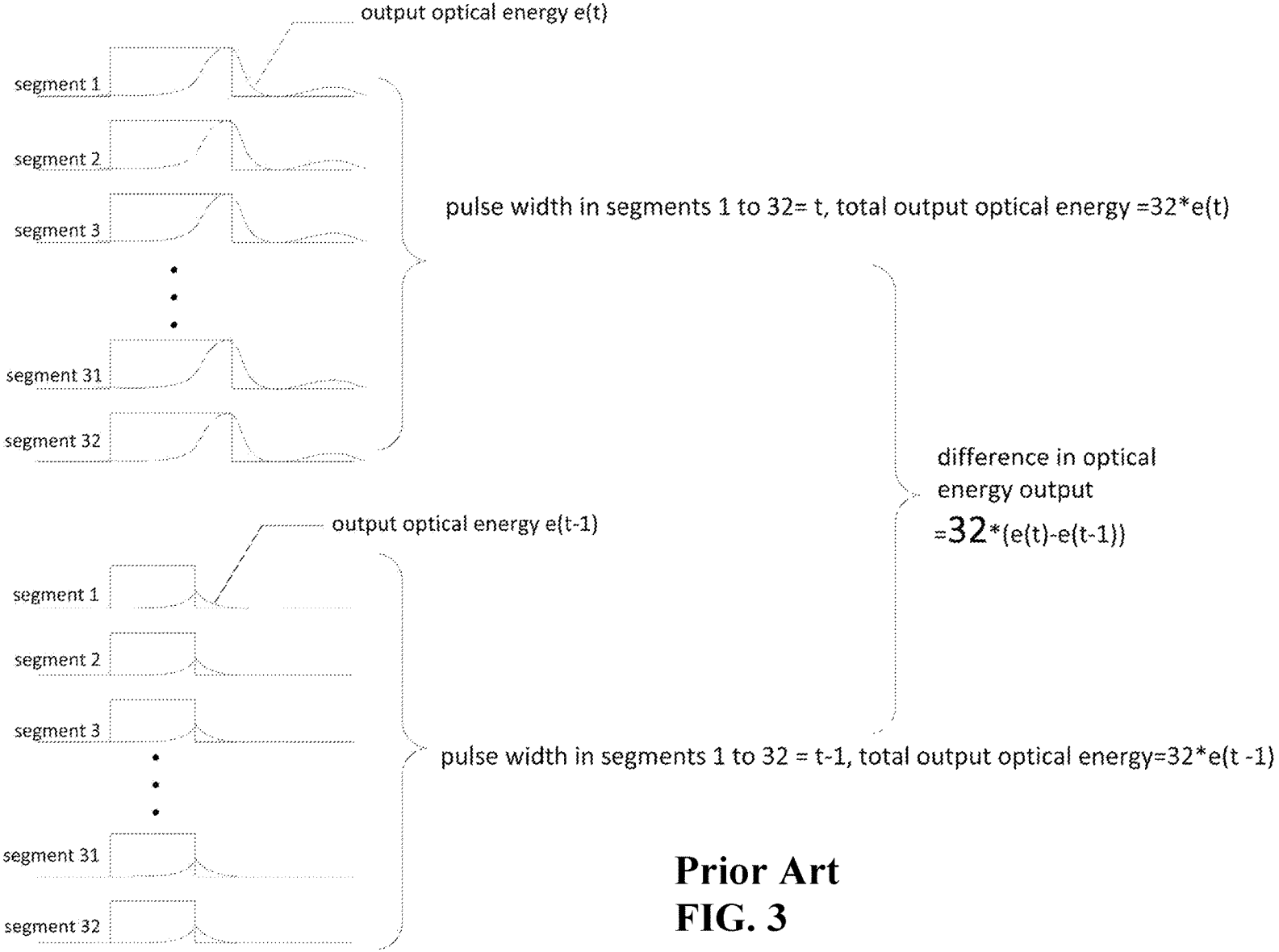
Prior Art FIG. 3
FIG. 3 illustrates the operation of prior art S-PWM scheme B.

FIG. 3 illustrates the optical energy output of LED in S-PWM scheme B shown in the middle pane in FIG. 1. In the bottom panel in FIG. 3, when the PWM pulse in each segment is (t−1) GCLKs, the optical energy output in one segment is e(t−1) and the total optical energy output in 32 segments is 32*e(t−1). When the pulse width in the segment is extended by one GCLK to a value of t GCLKs, the total optical energy output in 32 segments is 32*e(t), as shown in the top panel in FIG. 3. Accordingly, the difference in optical energy output caused by one GCLK is 32*(e(t)−e(t−1)).

Figure 4:
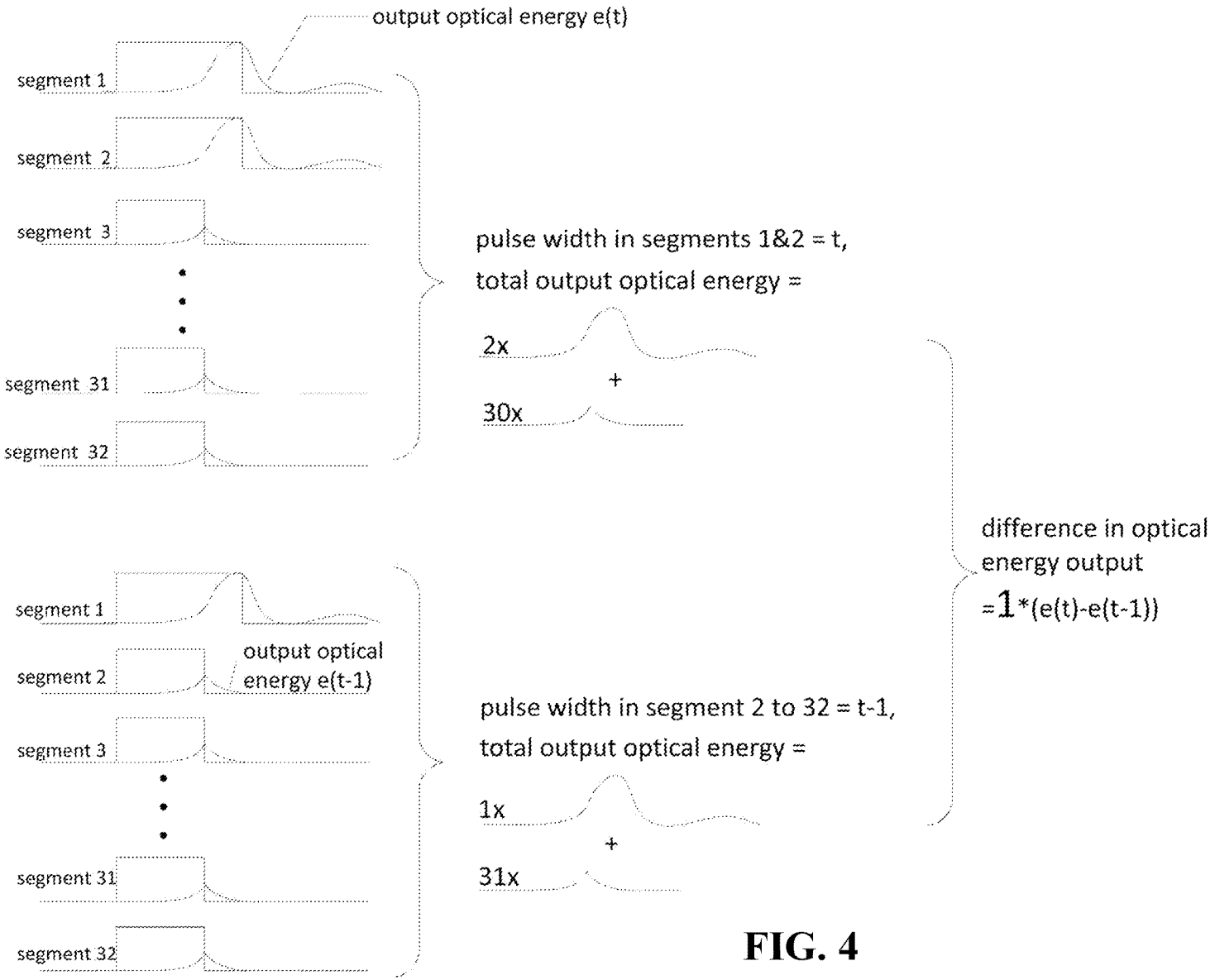
FIG. 4 illustrates the operation of the innovative S-PWM scheme C.

FIG. 4 illustrates the optical energy output of LED in the inventive S-PWM scheme C of this disclosure. In the bottom panel in FIG. 4, when the PWM pulse in Segment 1 is t GCLKs, while each of the remaining segments receives (t−1) GCLKs and remain unlit. When the input PWM value is increased by one GLCK, this one GCLK is distributed to Segment 2. The addition of one GLCK into Segment 2 is sufficient to light the LED, as shown in the top panel in FIG. 4. Accordingly, the difference in optical energy output caused by one GCLK is 1*(e(t)−e(t−1)).

Since S-PWM scheme B increases the PWM value in each of the 32 segments by the same number GLCKs, the LED is either on in all segments or remains unlit in all segments, which does not allow fine-tuning at low brightness. In contrast, S-PWM scheme C allows increasing the limited amount of PWM value in individual segments under certain conditions so that the LED emits light at least in some segments even at very low brightness levels. Accordingly, the S-PWM scheme B results in large increments in the optical energy output while the S-PWM scheme C allows fine-tuning of the optical energy output.

In some embodiments of the disclosure, the compensation value K is obtained by calibration. For example, the calibration is carried out through photo capturing and adjusting of the brightness of individual LEDs in the LED display. This calibration is normally carried out at high brightness. The purpose is to achieve uniformity in brightness across the display. In such a calibration, each individual LEDs in the LED display receives that same image data. A first photo of the LED display is taken, which shows variations of brightness of the LEDs. A first data is added to the image data and sent to the LEDs. A second photo is taken. Adjustments of the input image data are made and photos are taken until the uniformity in brightness meets the pre-determined criteria.

In a specific embodiment, each LED pixel is a RGB LED pixel that contains a red LED, a blue LED, and a green LED, each receiving its respective input image data X and obtaining a calibration coefficient $p_i$, i=r, g, or b. The coefficient $p_i$ obtained from the calibration for each individual LED is then stored in, e.g., a look-up table in a memory, such as a SRAM. The memory can be built on the same chip together with the driver circuitry or on a different chip coupled to the driver circuitry chip. The calibration data is retrieved when needed, e.g., at the power-up of the LED to preload the calibration data to a register in the driver circuitry.

In a further embodiment, the calibration process is carried out both under one high brightness condition to obtain a first set of calibration data and under one low brightness condition to obtain a second set of calibration data. In some embodiments, the performance characteristic at low brightness is flickering of the LED display, which can be monitored by visual inspection. Assuming, at a low brightness condition, an individual LED receives an input image data $X_i$ and is assigned a calibration data $q_i$ after the calibration process. Likewise, the calibration data $q_i$ can be stored in a memory in the driver circuit. Accordingly, calibration data $p_i$, $q_i$, or both are assigned to each individual LED. For a 1920×1080 pixel color LED display, there can be up to six matrices of calibration data—one 1920×1080 matrix for each of $p_r$, $p_b$, $p_g$, $q_r$, $q_b$, and $q_g$.

In certain embodiments, e.g., when light emitting from LEDs are consistent and uniform, it may not be necessary to apply a different $q_i$ to each individual LED. Instead, all LEDs of the same color in the LED display panel can use one set of calibration data at low brightness, high brightness, or both. I.e., at low brightness, all red LEDs use the same $q_r$, all blue LEDs use the same $q_b$, and all green LEDs use the same $q_g$, thereby reducing three matrices of 1920×1080 for $q_r$, $q_b$, and $q_g$ to three numbers. Independently from what values of $q_r$, $q_b$, and $q_g$ are used for low brightness, at high brightness, all red LEDs may use the same $p_r$, all blue LEDs use the same $p_b$, all green LEDs use the same $p_g$, thereby reducing three matrices of 1920×1080 for $p_r$, $p_b$, and $p_g$ to three numbers. Such simplifications reduce the size of the memory needed for storing the calibration data. In these embodiments, the q values and the p values can be selected based on empirical experiences or based on a value obtained from the calibrations.

Both the q values and the p values are used in determining the compensation value K so that optimal compensation of the LED can be obtained in the full range of brightness levels.

In another embodiment of this disclosure, the grouping number $G_0$ and the segment number $S_0$ can be determined based on experience or obtained by calibration. The $S_0$ and $G_0$ are stored in the driver circuitry of the LED display, e.g., in a register. In the calibration process, an initial $G_0$ value (e.g., 8) and/or an initial $S_0$ (e.g., 32) values are set in the driver circuitry, the LED display is run at various brightness levels, especially low brightness levels, to test performance characteristics such as flickering and brightness uniformity. The $G_0$ and $S_0$ can be adjusted until the performance meets or exceeds a pre-determined criteria.

Note that the values of $p_r$, $p_b$, $p_g$, $q_r$, $q_b$, $q_g$, $G_0$, and $S_0$ can be obtained through calibration of the LED display or can be per-determined without calibration, e.g., based on experience.

Figure 5:
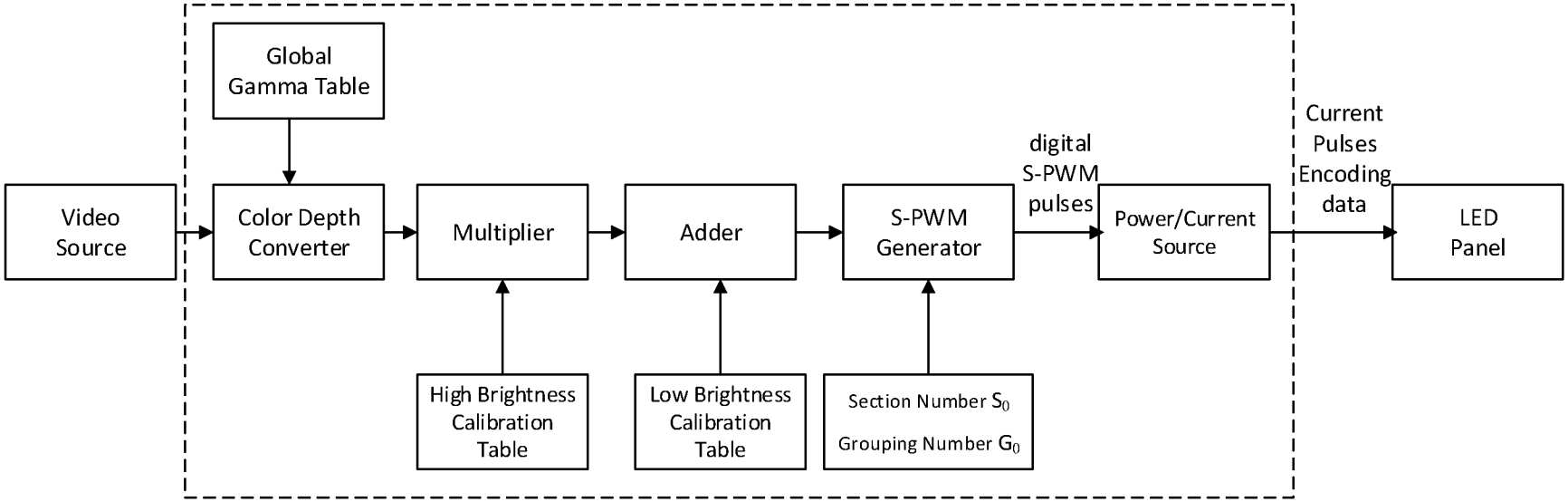
FIG. 5 is a block diagram showing an LED display system of the current disclosure.

FIG. 5 is a block diagram of an exemplary LED display system of the current disclosure. A video source sends video data (8, 10, or 12-bits) to the LED display system that has an LED display panel and an LED driver circuitry. The video data is Gamma corrected and converted to 16-bits data in a color depth converter. The 16-bits data stream enters a multiplier in which a first set of calibration data is combined into the data stream. The first set of calibration data is obtained under a high brightness condition, i.e., high brightness calibration. Assuming the input data to be $X_i$, the high brightness calibration.

Data from the multiplier enters an adder where the second set of calibration data, $q_i$, is added. The second set of calibration data is obtained under a low brightness condition, i.e., low brightness calibration. Assuming the calibration data adds $q_i$ GCLKs to $N_1$, the output data $N_2$ from the adder equals $(N_1+q_i)$ or $(\text{floor}(p_i*X)+q_i)$. As such, the compensation value $K=(\text{floor}(p_i*X)+q_i)-X$. Therefore, the compensation value K is informed by both the high brightness calibration and the low brightness calibration, corresponding to the curves shown in Panel C of FIG. 2.

The calibrated image data (X+K) is sent to a S-PWM engine, which receives a preset segment number $S_0$ and a preset grouping number $G_0$ from a register and generates digital PWM signals. The digital PWM signals are sent to a plurality of power sources. The power sources in turn drive a scan-type LED display panel, which may be either a common anode configuration or a common cathode configuration.

In the common anode configuration, the LED display panel has an array of RGB LED pixels arranged in rows and columns. The LED array has a plurality of common anode nodes. Each of the plurality common anode nodes operably connects anodes of LEDs of a same color in a row to a corresponding scan switch. The cathodes of the LED pixels in a same column are connected to a power source.

In the cathode configuration, the LED pixel array has a plurality of common cathode nodes. Each of the plurality common cathode nodes operably connects cathodes of LEDs in a row to a corresponding scan switch. The anodes of LEDs of a same color in a column of LED pixels are connected to a current source.

Many modifications and other embodiments of the disclosure will come to the mind of one skilled in the art having the benefit of the teaching presented in the forgoing descriptions and the associated drawings. For example, the driver circuit can be used to drive an LED array in either common cathode or common anode configuration. Elements in the LED array can be single color LEDs or RGB units or any other forms of LEDs available. The driver circuit can be scaled up or scaled down to drive LED arrays of various sizes. Multiple driver circuits may be employed to drive a plurality of LED arrays in a LED display system. The components in the driver can either be integrated on a single chip or on more than one chip or on the PCB board. Further, the display can be any suitable display, including large outdoor display panel or small micro display for cell phones. Such variations are within the scope of this disclosure. It is to be understood that the disclosure is not to be limited to the specific embodiments disclosed, and that the modifications and embodiments are intended to be included within the scope of the dependent claims.

We claim:

1. An LED display system, comprising:

an LED display panel; and a driver circuitry that drives the LED display panel, wherein the driver circuitry comprises a scrambled PWM generator, a register, and a memory, wherein the scrambled PWM generator receives a compensated image data of a grayscale value (X+K), X being a grayscale value of a data from an external image source and K being a compensation value generated by the driver circuitry, wherein the scrambled PWM generator distributes the grayscale value (X+K) into a plurality of segments according the following set of rules:

when (X+K) equals or is smaller than G0*S0, S=ceil((X+K)/G0) and R=mod(X+K, G0), wherein G0 is a grouping number and S0 is a preset segment number stored in the driver circuitry, S is the number of output segments, among which S−1 segments has a pulse width of G0 GCLKs and one segment has a pulse width of R; and when (X+K) is larger than G0*S0, M=floor((X+K)/S0) and L=mod(X+K, S0), wherein L is the number of segments that each receives a pulse width of M+1, while the remaining S0−L segments each receives a pulse width of M.

2. The LED display system according to claim 1, wherein the compensation value K is predetermined or is obtained through measuring one or more performance characteristics of the LED display panel.

3. The LED display system according to claim 2, wherein the one performance characteristic of the LED display panel is a brightness uniformity.

4. The LED display system according to claim 1, wherein the grouping number is predetermined or is obtained by measuring one or more performance characteristics of the LED display.

5. The LED display system according to claim 3, wherein the one performance characteristic is flickering of the LED display panel.

6. The LED display system according to claim 1, wherein the LED display panel comprises an LED array of RGB LED pixels, wherein the LED array has a plurality of common anode nodes, each of the plurality common anode nodes operably connects anodes of LEDs of a same color in a row to a corresponding scan switch, and cathodes of LED pixels in the same column are operably connected to a power source.

7. The LED display system according to claim 1, wherein the LED display panel comprises an LED array of RGB LED pixels, wherein the LED array has a plurality of common cathode nodes, each of the plurality of common cathode nodes operably connects cathodes of LED pixels in a row to a corresponding scan switch, and anodes of LEDs of a same color in a column of LED pixels are operably connected to a current source.

8. A method for operating an LED display system, comprising:

connecting an LED display panel to a driver circuitry comprising a scrambled PWM generator;

sending an image data to the driver circuitry, wherein the image data has a value of X;

adding a compensation value K to the value of the image data X to form a compensated image data having a grayscale value of (X+K);

sending the compensated image data into the scrambled PWM generator, wherein the scrambled PWM generator scrambles the compensated image data into a number of segments according to the following rules:

when (X+K) equals or is smaller than G0*S0, S=ceil((X+K)/G0) and R=mod(X+K, G0), wherein G0 is a grouping number and S0 is a preset segment number stored in the driver circuitry, S is the number of output segments, among which S−1 segments has a pulse width of G0 GCLKs and one segment has a pulse width of R; and when (X+K) is larger than G0*S0, M=floor((X+K)/S0) and L=mod(X+K, S0), wherein L is the number of segments that each receives a pulse width of M+1, while the remaining S0−L segments each receives a pulse width of M; and sending the PWM pulses from the scrambled PWM generator to a plurality of power sources or a plurality of current sources.

9. The method according to claim 8, further comprising calibrating the LED display to obtain a value of the group number G0 by measuring flickering of the LED display.

10. The method according to claim 9, further comprising storing a preset value of the group number G0 in a memory in the driver circuitry.

11. The method according to claim 8, further comprising calibrating the LED display for brightness uniformity at a high brightness level to obtain a first set of calibration data.

12. The method according to claim 11, further comprising calibrating the LED display for brightness uniformity at a low brightness level to obtain a second set of calibration data.

13. The method for operating an LED display according to claim 12, further comprising determining the compensation value K using the first set of calibration data and the second set of calibration data.

14. The method according to claim 9, wherein the compensation value K is predetermined.

* * * * *